US007110689B2

(12) United States Patent
Takahashi

(10) Patent No.: US 7,110,689 B2
(45) Date of Patent: Sep. 19, 2006

(54) IMAGE HEATING APPARATUS WITH MECHANISM TO PREVENT TWINING RECORDING MATERIAL

(75) Inventor: Katsumi Takahashi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 10/834,237

(22) Filed: Apr. 29, 2004

(65) Prior Publication Data

US 2004/0247333 A1 Dec. 9, 2004

(30) Foreign Application Priority Data

May 1, 2003 (JP) ..... 2003-126222

(51) Int. Cl.
*G03G 15/20* (2006.01)
*G03G 15/00* (2006.01)

(52) U.S. Cl. ..... 399/68; 399/21

(58) Field of Classification Search ..... 399/21, 399/22, 68, 322

See application file for complete search history.

(56) References Cited

U.S. PATENT DOCUMENTS 4,054,380 A * 10/1977 Donohue et al. ..... 399/21 X
4,796,035 A 1/1989 Kawasaki et al.
4,839,754 A * 6/1989 Gami et al. ..... 360/73.01
4,937,622 A * 6/1990 Makiura ..... 399/21
5,290,024 A 3/1994 Takahashi ..... 271/122
5,365,322 A 11/1994 Hamada et al.
5,474,287 A 12/1995 Takahashi ..... 271/10.13
5,597,152 A * 1/1997 Chinzei ..... 270/39.05
5,666,595 A 9/1997 Sameshima et al. ..... 399/110
5,909,872 A 6/1999 Takahashi ..... 271/116
5,943,524 A * 8/1999 Eom ..... 399/21 X
6,311,039 B1 10/2001 Funamizu et al. ..... 399/394
6,397,035 B1 5/2002 Kataoka et al. ..... 399/388
6,456,807 B1 * 9/2002 Makino et al. ..... 399/167
2003/0143011 A1 7/2003 Yoshikawa et al. ..... 400/578

FOREIGN PATENT DOCUMENTS

JP 6-175524 6/1994
JP 2000-344395 12/2000

* cited by examiner

*Primary Examiner*—Sandra L. Brase
(74) *Attorney, Agent, or Firm*—Fitzpatrick, Cella, Harper & Scinto

(57) ABSTRACT

The image forming apparatus includes a rotatable first rotary member, a rotatable second rotary member brought into pressure contact with the first rotary member, and forming a nip part for nipping and conveying a recording material, first recording material detector located at the vicinity of the nip part downstream of the nip part with respect tot he conveying direction of the recording material for detecting the passage of the recording material, a drive unit for rotatively driving the first rotary member, a brake for applying the brakes to the rotation of the first rotary member, and a controller for controlling the brake, and during jam near the first rotary member, the driving of the drive unit is stopped. Thereby, the amount of wrapping during the wrapping jam of the recording material around the fixing rotary member can be made small.

2 Claims, 10 Drawing Sheets

IMAGE HEATING APPARATUS WITH MECHANISM TO PREVENT TWINING RECORDING MATERIAL

BACKGROUND OF THE INVENTION

1. Field of the Invention

An image forming apparatus using an electrophotographic process has a heating apparatus for nipping and conveying a recording material bearing thereon an image formed of a toner comprising resin, a magnetic material, a coloring material, etc. by the pressure contact part (nip part) of fixing means (a roller, an endless belt member or the like) and pressure means (a roller, an endless belt member or the like) being in pressure contact with each other and rotated, and applying heat and pressure thereto to thereby heat the image.

2. Related Background Art

Heretofore, in an image forming apparatus such as a copying machine, a laser beam printer or a facsimile-apparatus, there has been a fixing apparatus for heating and fixing an unfixed toner image transferred onto a recording material having a construction which is provided with a fixing roller containing a heating source such as a halogen lamp or the like therein, and a pressure roller also containing a heating source therein and being in pressure contact with the fixing roller, and in which the recording material is nipped and conveyed by a nip part formed by the fixing roller and the pressure roller to thereby fix the unfixed toner image on the recording material by heat.

The halogen lamps which are the heating sources in the fixing roller and the pressure roller are ON/OFF-controlled on the basis of signals from temperature sensors mounted on the respective surfaces of the fixing roller and the pressure roller so that the surfaces thereof may be controlled to a predetermined temperature.

In such a construction, during fixing, the surface of the fixing roller and the toner image in its molten state come into contact with each other and thus, there is the possibility of the recording material twined on the fixing roller.

So, as a technique of preventing such wrapping of the recording material, it is generally known as being effective as shown in FIG. 3 of the accompanying drawings to bring a pawl 250 into contact with other location than the nip part of a fixing roller 212, and force the leading edge of a recording material to be stripped off by this pawl 250. Also, as shown in FIG. 3, a cleaning member for the fixing roller 212 is provided to thereby remove any residual toner on the fixing roller 212, and enhance the mold releasing ability of the toner on the recording material relative to the fixing roller 212 and enhance the separability of the recording material relative to the fixing roller. Here, the reference numeral 235 designates a cleaning web comprising unwoven cloth impregnated with silicon oil, the reference numeral 237 denotes a feeding side roll, the reference numeral 238 designates a take-up side roll, and the reference numeral 236 denotes a foamed roller. Even if such a countermeasure is provided, it is difficult to completely prevent the twining of the recording material around the fixing roller, due to a reduction in the separating capability of the separating pawl resulting from the abrasion thereof, and a reduction in the amount of applied oil resulting from the higher conveying velocity of the recording material. In order to improve this, there have heretofore been provided detecting sensors for the recording material at the entrance and exit of the fixing apparatus so that the fixing apparatus can detect the twining of the recording material (Japanese Patent Application Laid-Open No. H6-175524 and Japanese Patent Application Laid-Open No. 2000-344395). A simple embodiment thereof is shown in FIG. 4 of the accompanying drawings. When the distance between a fixing entrance sensor 239 and a fixing exit sensor 240 provided in a paper conveying path before and behind the fixing apparatus for detecting the presence or absence of paper is defined as c, and the outer peripheral length of the fixing roller 212 is defined as d, and the distance from the fixing nip part to the fixing exit sensor 240 is defined as a, and the length of a recording material P of a minimum size is defined as e, the fixing apparatus is constructed so that the relation among a, c, d and e may be e>c>d>a. If in the thus constructed fixing apparatus, the recording material P does not reach the fixing exit sensor 240 within a predetermined time after it has passed the fixing entrance sensor 239, it is judged that there is the possibility of the leading edge of the recording material having wrapped the pair of fixing rollers, and the fixing roller 212 and the pressure roller 213 are stopped and the recording material can be prevented from coming into the fixing member any further.

In the conventional construction, however, even if a signal for stopping the rotation of a motor is outputted, the motor is stopped while being naturally decelerated by the rotation resistance or the like of the fixing roller 212 and the pressure roller 213. Therefore even if it is judged that there is the possibility of the recording material having wrapped the fixing roller and the signal for stopping the rotation of the motor is outputted, if the inertial forces of the fixing roller 212 and the pressure roller 213 are great, the time until the motor is stopped will become correspondingly longer. Thereby, even if the twining of the trailing edge of the recording material around the fixing roller 212 and the pressure roller 213 is detected and an attempt is made to stop the fixing roller 212 and the pressure roller 213, they tend to continue to be rotated by their inertial forces, and this has led to the undesirable possibility of even the trailing edge of the recording material completely wrapping the fixing roller 212 or the pressure roller 213 within the time until these rollers are completely stopped. Particularly in the higher speed of the image forming apparatus in recent years, there is adopted a construction in which in order to make the irregular rotation of the fixing roller when the recording material rushes into the nip as small as possible, the inertial force of the fixing roller is made great and the fluctuation of the speed is made small and therefore, the time until the fixing roller and the pressure roller are completely stopped becomes longer and longer, and the problem as noted above becomes remarkable. The work of removing the recording material when the recording material P has completely wrapped the fixing roller 212 or the pressure roller 213 is very difficult to a user, and if it extends to such a degree as calls a serviceman, a reduction in the working efficiency of the image forming apparatus will become unavoidable and productivity will be reduced.

SUMMARY OF THE INVENTION

So, it is an object of the present invention to reduce the amount of twining during jam when a recording material is twined on a fixing rotary member.

It is another object of the present invention to shorten the time until drive is stopped by a drive stopping signal for drive means for a fixing rotary member.

It is still another object of the present invention to provide an image forming apparatus having:

a rotatable first rotary member;

a rotatable second rotary member brought into pressure contact with the first rotary member and forming a nip part for nipping and conveying a recording material;

first recording material detecting means located at the vicinity of the nip part downstream of the nip part with respect to the conveying direction of the recording material for detecting the passage of the recording material;

drive means for rotatively driving the first rotary member;

brake means for applying the brakes to the rotation of the first rotary member; and control means for controlling the brake means;

wherein during jam near the first rotary member, the driving of the drive means is stopped and the control means makes the brakes by the brake means great.

Further objects of the present invention will become apparent from the following description.

DESCRIPTION OF THE PREFERRED EMBODIMENTS

An embodiment of the present invention will hereinafter be described in detail.

Figure 1:
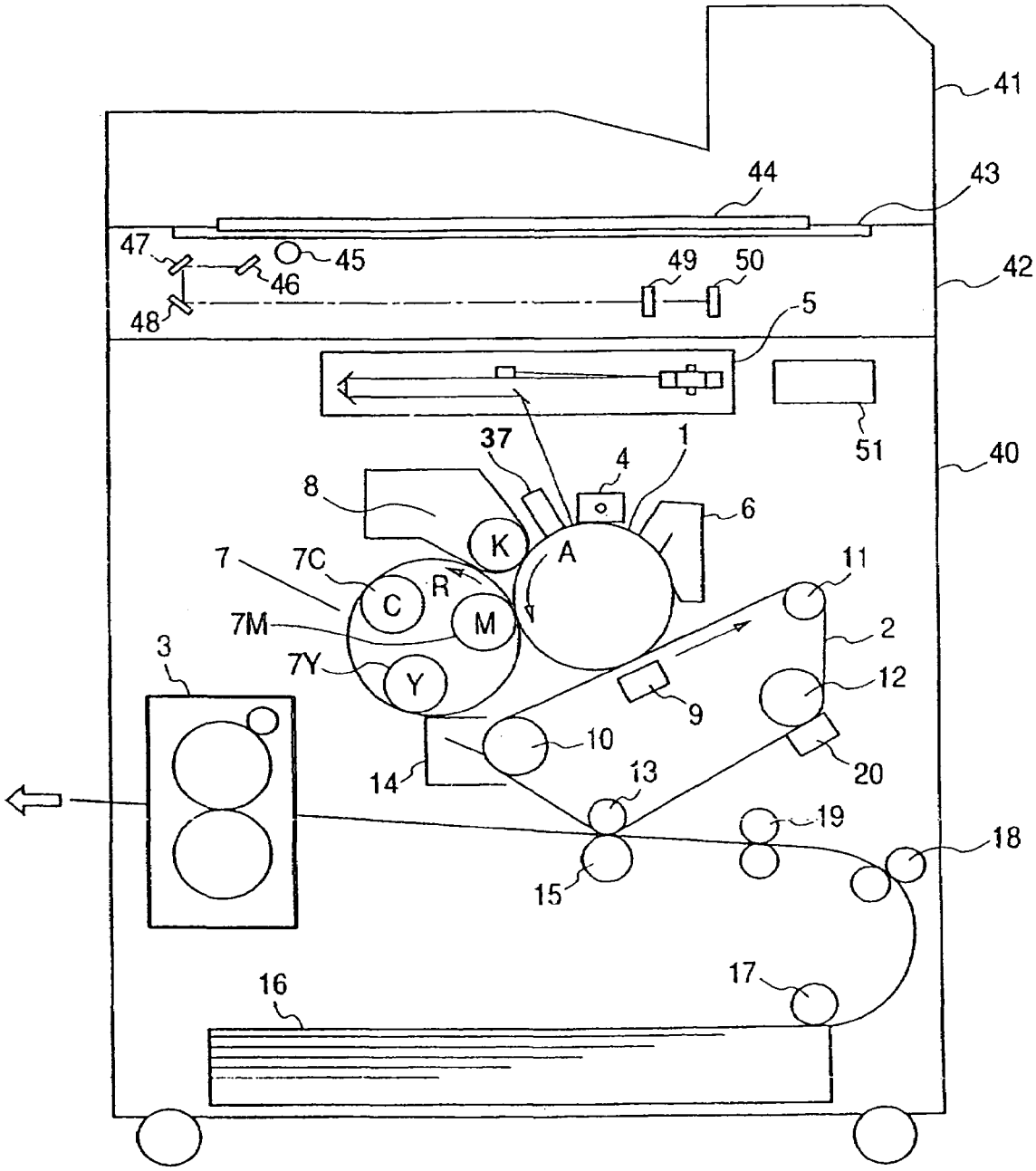
FIG. 1 is a longitudinal cross-sectional view of the image forming apparatus of the present invention.

FIG. 1 is a cross-sectional view showing the construction of an example of an image forming apparatus to which the present invention is applied.

The reference numeral 40 designates the main body of a color copying machine. In the upper portion of the main body of this color electrophotographic copying machine, there are disposed an automatic original conveying apparatus 41 for automatically conveying originals 44 one by one in their separated states, and an original reading apparatus 42 for reading images on the originals 44 conveyed by the automatic original conveying apparatus 41. This original reading apparatus 42 is adapted to illuminate the original 44 placed on platen glass 43 by a light source 45, scan and expose a reflected light image from the original 44 on an image reading element 50 comprising a CCD or the like through a reduction optical system comprising optical mirrors 46, 47, 48 and an imaging lens 49, and read the color material reflected light image of the original 44 at predetermined dot density by the image reading element 50.

The color material reflected light image of the original 44 read by the above-described original reading apparatus 42 is sent as data of three colors, i.e., red (R), green (G) and blue (B), to an image processing apparatus 51 and in this image processing apparatus, image processing such as shading correction, gamma correction and color space processing is effected on the R, G and B data of the original 44.

The image data subjected to the predetermined image processing in the image processing apparatus 51 are sent as yellow (Y), magenta (M), cyan (C) and black (K) image data to an exposing apparatus 5, in which image exposure by a laser beam is effected in conformity with the image data.

The exposure of the image by the exposing apparatus 5 is effected on a photosensitive drum 1 which is an image bearing member. The photosensitive drum 1 is provided so as to be rotatable in the direction of arrow A by a drum motor. Around the photosensitive member 1, there are disposed a primary charging device 4, a potential sensor 37, the exposing apparatus 5, a color developing unit 7, a black-and-white developing unit 8, a transfer charging device 9 and a cleaner apparatus 6.

For the forming of an image, a voltage is first applied to the charging device 4 to thereby uniformly minus-charge the surface of the photosensitive member 1 by charging part potential. This charging level is detected by the potential sensor 37, and on the basis of the result of this detection, the output intensity of the charging device 4 is feedback-controlled. Subsequently, the exposing apparatus 5 comprising a laser scanner effects exposure on the basis of the image data so that an image portion on the charged photosensitive member 1 may assume predetermined exposed part potential, whereby a latent image is formed. The exposing apparatus 5 is turned on and off on the basis of the image data to thereby form a latent image corresponding to the image.

The color developing unit 7 comprises three developing apparatuses 7Y, 7M and 7C for full-color developing. The color developing apparatuses 7Y, 7C and a black-and-white developing apparatus 8 develop the latent image on the photosensitive member 1 with Y, M, C and K toners. When the latent image is to be developed with the toner of each color, the color developing unit 7 is rotated in the direction of arrow R by a drive source and is aligned so that the developing apparatus of the pertinent color may contact with the photosensitive member 1.

The toner images of the respective colors developed on the photosensitive member 1 are successively transferred to a belt 2 as an intermediate transfer member, whereby the toner images of the four colors are superposed one upon another. A belt cleaner 14 is provided at a location opposed to a transfer belt driving roller 10 with the belt 2 interposed therebetween, and any residual toners on the belt 2 are scraped off by a blade.

The toner images transferred to the belt 2 are further transferred to a recording material by a secondary transfer apparatus 15. During full-color print, the toners of the four colors are superposed one upon another on the belt, and thereafter are transferred to the recording material. The recording material is drawn but of a recording material cassette 16 to a conveying path by a pickup roller 17, and is fed to a nip part, i.e., the contact portion between the secondary transfer apparatus 15 and the belt 2 by pairs of conveying rollers 18 and 19.

Also, the toners residual on the photosensitive member 1 are brought into a state easy to clean the charges of the toners by a preliminary cleaning apparatus, and are removed and collected by a cleaner apparatus 6, and lastly, the photosensitive member 1 is uniformly charge-eliminated to the vicinity of 0 volt by a residual charge eliminating apparatus (not shown), and becomes ready for the next image forming cycle.

The recording material to which the toner images have been transferred is fed to a fixing apparatus 3. The toner images on the recording material are heat-fixed by the fixing apparatus 3 and the recording material is discharged out of the image forming apparatus. The fixing apparatus 3 is constructed as a pair of rollers which are a pair of rotary members comprising two rollers having therein halogen heaters which are heat generating means and rotatably disposed while being brought into pressure contact with each other by a pressure mechanism, not shown.

Now, the image forming timing of the above-described color copying machine is controlled with a predetermined position on the belt 2 as the reference. The belt 2 is passed over rollers 10, 11, 12 and 13. Of these rollers, a transfer belt driving roller 10 functions as a drive roller coupled to a drive source, not shown, and driving the belt 2, and transfer belt tension rollers 11 and 12 function as tension rollers for adjusting the tension of the belt 2, and a backup roller 13 functions as the backup roller of the transfer roller 15 as the secondary transfer apparatus.

A reflection type sensor 20 for detecting a reference position is disposed near the tension roller 12. The reflection type sensor 20 detects marking such as a reflecting tape provided on the end portion of the outer peripheral surface of the belt 2 and outputs I-top signal.

The outer peripheral length of the photosensitive member 1 and the circumferential length of the belt 2 are at an integer ratio represented by 1:n (n being an integer). If such setting is adopted, the photosensitive member 1 is rotated integer times and returns to entirely the same state as that before one round of the belt during the time when the belt 2 makes one round and therefore, it is possible to avoid color misregister due to the uneven rotation of the photosensitive member 1 when the four colors are superposed on the intermediate transferring belt 2 (the belt makes four rounds).

In the image forming apparatus of the intermediate transfer type as described above, exposure is started by the exposing apparatus 5 comprising a laser scanner after the lapse of a predetermined time after the I-top signal has been detected. Also, as previously described, the photosensitive member 1 is rotated integer times and returns to entirely the same state as that before one round of the belt 2 during the time when the belt 2 makes one round and therefore, the toner images are formed always at the same position on the belt 2. Since the size of the toner images are also varied by the size of the paper, on the belt 2, there exists a range on which the toner images never get.

Figure 2:
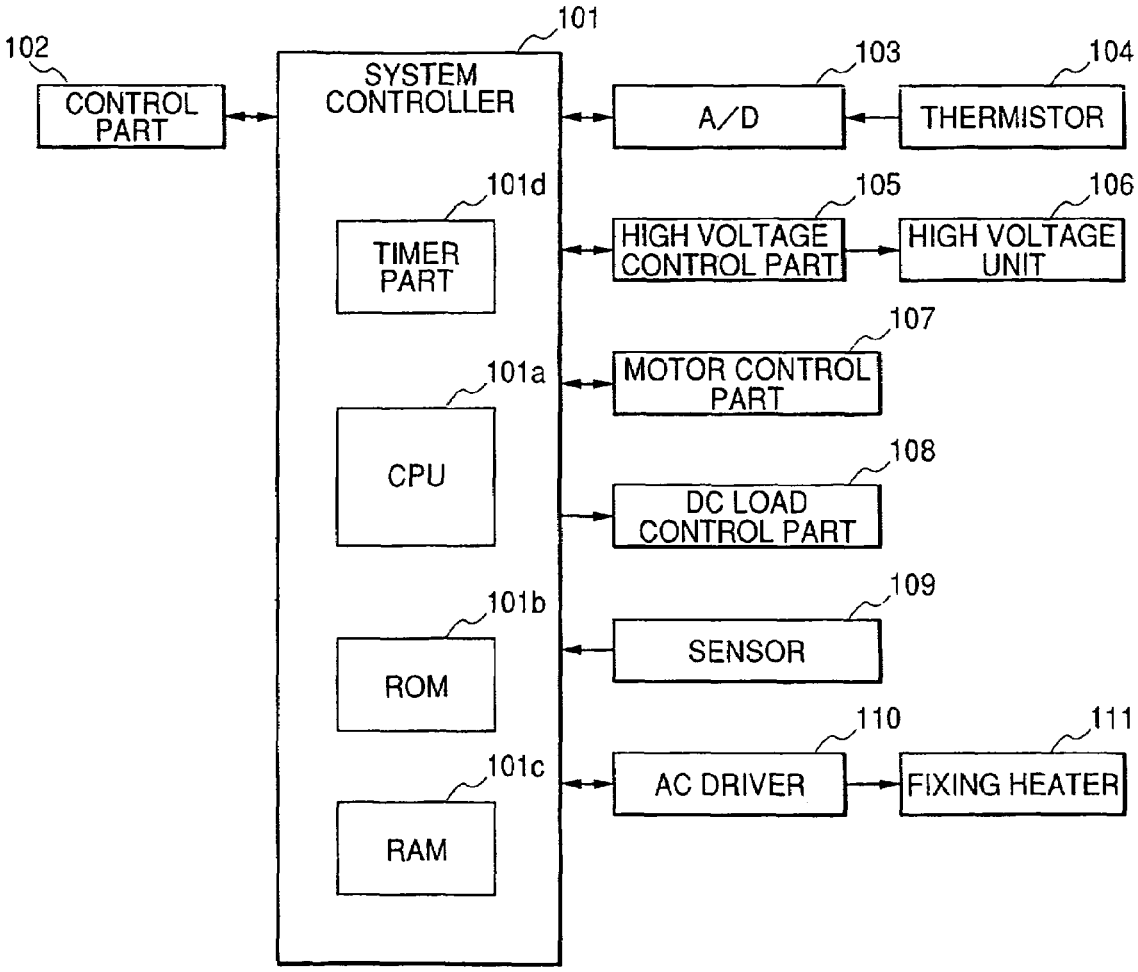
FIG. 2 is a block diagram of the control system of the image forming apparatus of the present invention.
Figure 3:
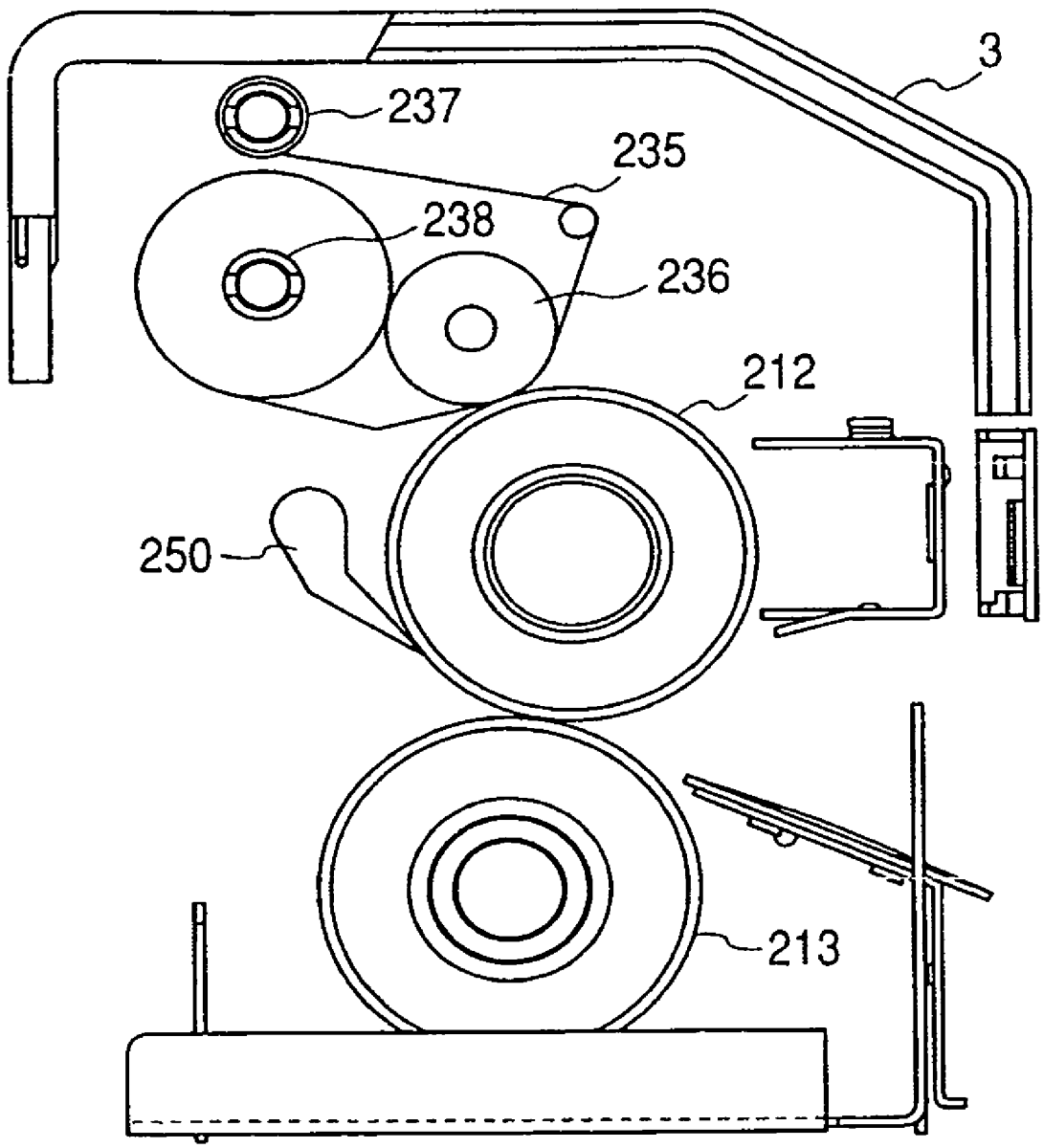
FIG. 3 is a schematic view of a fixing apparatus.
Figure 4:
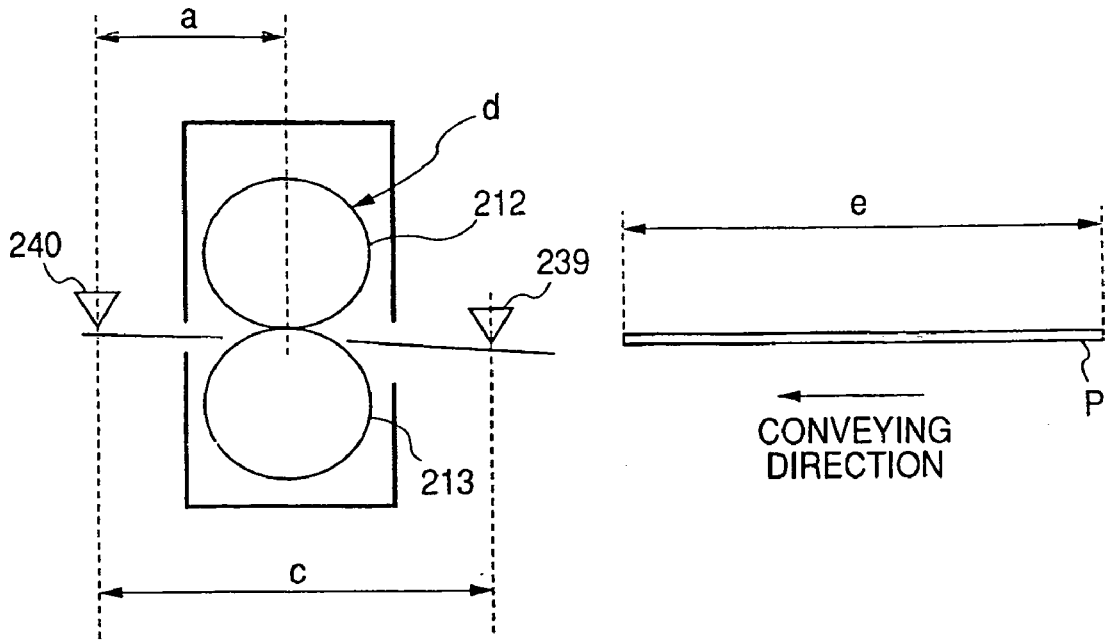
FIG. 4 shows the positional relation between the fixing entrance sensor and fixing exit sensor of the fixing apparatus.

Next, FIG. 2 shows a block diagram of the control system of the present image forming apparatus.

The present image forming apparatus is generally controlled by a system controller 101. The system controller 101 performs chiefly the functions of driving each load in the present image forming apparatus, collecting and analyzing the information of sensors, and interchanging data with an operating part 102, i.e., a user interface. The interior of the system controller 101 mounts a timer 101*d* and CPU 101*a* in order to perform the above-described functions, and the CPU 101*a* executes various sequences related to a predetermined image forming sequence by a program stored in a ROM 101*b* likewise mounted on the system controller 101. It also mounts a RAM 101*c* in order to store therein rewritable data needed to be primarily or permanently preserved at that time. The RAM 101*c* preserves therein, for example, a high voltage set value to a high voltage control part 105 which will be described later, various data which will be described later, image forming command information from the operating part 102, etc.

The operating part 102, in addition to obtaining such information as a copying magnification and a density set value set by the user, delivers information about the state of the image forming apparatus, for example, the number of sheets for image forming and whether image forming is going on, the occurrence of jam and data for showing the location thereof to the user.

This image forming apparatus has disposed at various locations therein one or more motors, DC loads such as a clutch/solenoid, and sensors such as a photointerrupter and a microswitch. That is, the motor or motors and each DC load are suitably driven to thereby effect the conveyance of the recording material and the driving of each unit, and the various sensors monitor those operations. So, the system controller 101 controls each motor by a motor controlling part 107 on the basis of signals from the various sensors 109 and at the same time, operates the clutch/solenoid by a DC load controlling part 108 to thereby progress an image forming operation smoothly. Also, it delivers various high voltage control signals to the high voltage controlling part 105 to thereby apply an appropriate high voltage to a primary charging device, an auxiliary charging device, not shown, and a transfer charging device, not shown, which are charging devices constituting a high voltage unit 106, and developing rollers in developing devices. Further, fixing rollers as the heating rotary members of the fixing apparatus 3 contain therein heaters 111 for heating the respective rollers, and each of the heaters is ON/OFF-controlled by an AC driver 110. Also, in this case, each fixing roller is provided with a thermistor 104 as a temperature detecting member for detecting the temperature thereof, and a change in the resistance value of the thermistor 104 conforming to a change in the temperature of each fixing roller is converted into a voltage value by an A/D converter 103, whereafter it is inputted as a digital value to the system controller 101. The aforedescribed AC driver 110 is controlled on the basis of this temperature data.

Figure 5:
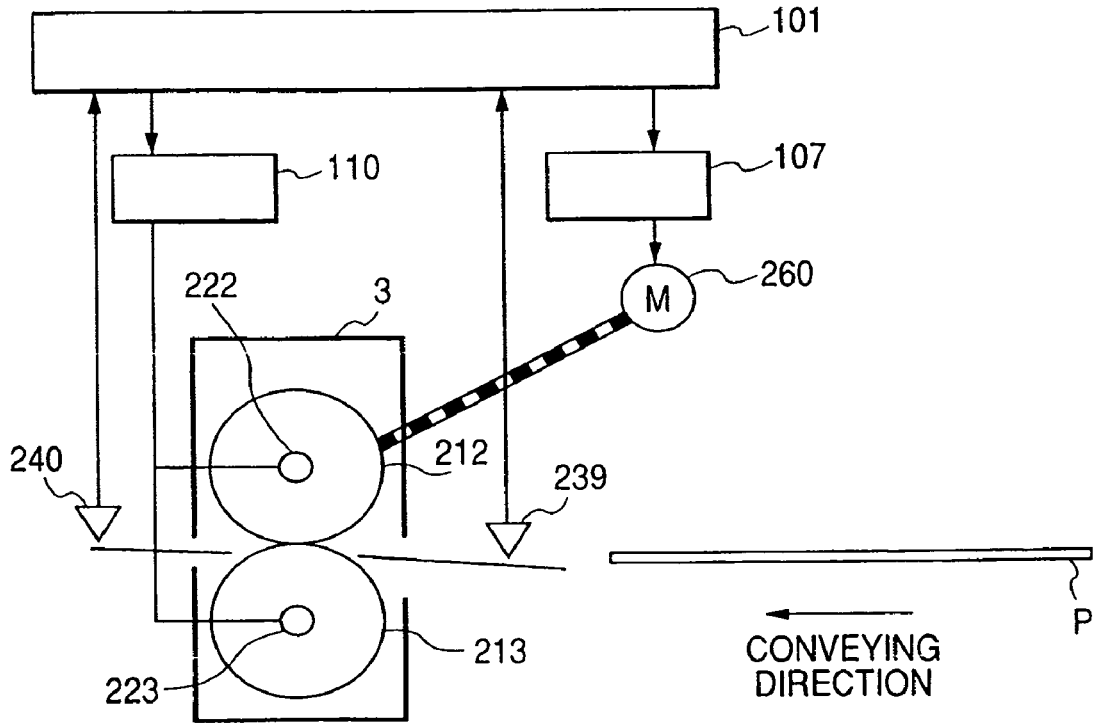
FIG. 5 shows a fixing apparatus according to an embodiment of the present invention.

The construction of the fixing apparatus of the present invention will now be described with reference to FIG. 5.

The fixing apparatus 3 is such that a fixing roller 212 as a heating rotary member having therein a halogen heater 222 as a heat generating member and a pressure roller 213 as a pressure rotary member also having therein a halogen heater 223 which is a heat generating member are constricted as a pair of fixing rotary members rotatably disposed while being brought into pressure contact with each other by a pressing mechanism, not shown. The fixing roller 212 and the pressure roller 213 are rotatively driven by a fixing motor 260 as drive means. The fixing motor 260 is controlled by the system controller 101 through the motor controlling part 107. The details of the control of the fixing motor will be described later.

The fixing roller 212 is constructed with a high temperature vulcanized (HTV) type silicone rubber layer as an elastic layer provided on the outer periphery of a mandrel made of aluminum, and a room temperature vulcanized (RTV) type silicone rubber layer as a heat-resistant elastic layer further provided on the outer periphery of the HTV silicone rubber layer. The outer diameter of the fixing roller 212 in the present embodiment is 60 mm.

On the other hand, the pressure roller 213 is constructed with an HTV silicone rubber layer as an elastic layer having a thickness of 1 [mm] provided on the outer periphery of a mandrel made of aluminum, and a fluorine resin layer which is a mold releasable layer further provided on the outer periphery of the HTV silicone rubber layer. The outer diameter of the pressure roller 213 in the present embodiment is 60 mm.

Thermistors which are temperature detecting members are brought into contact with the fixing roller 212 and the pressure roller 213, and on the basis of the values of these thermistors, the surface temperatures of the fixing roller 212 and the pressure roller 213 are found by the system controller 101. The system controller controls the amounts of electric power supply to the halogen heaters with reference to the detected temperatures to thereby control the halogen heaters 222 and 223 through the AC driver 110 so as to maintain the temperatures of the fixing roller 212 and the pressure roller 213 at respective set temperatures. Design is made such that by the fixing apparatus 3 kept at a predetermined temperature suitable for toner fixing in this manner, the unfixed images formed by the developers such as the toners and transferred onto the recording material pass through the nip part between the fixing roller 212 and the pressure roller 213 in the fixing apparatus 3 and are heated and pressurized, and are fixed on the recording material.

Here, when passing the transferring sheet P through the fixing apparatus 3, it is important to immediately stop the fixing roller 212 and the pressure roller 213 to thereby prevent the sheet from coming into the fixing member any further during the occurrence of jam in which the wrapping (twining) of the paper around the fixing roller 212 and the pressure roller 213 is feared.

So, in the present image forming apparatus, a fixing entrance sensor 239 as second recording material detecting means for detecting the presence or absence of sheet and a fixing exit sensor 240 as first detecting means are provided in sheet conveying paths before and behind the fixing apparatus.

By the two sensors being thus disposed, if the transferring sheet P does not arrive the fixing exit sensor 240 within a predetermined time after it has passed the fixing entrance sensor 239, it can be judged that there is the possibility of the transferring sheet having wrapped the fixing roller 212 or the pressure roller 213.

When the distance between the fixing entrance sensor 239 and the fixing exit sensor 240 is defined as distance (c), and the outer peripheral length of the fixing roller 212 is defined as length (d), and the distance between the fixing nip part and the fixing exit sensor 240 is defined as distance (a), and the length of the transfer paper P of a minimum size is defined as length (e), the fixing apparatus is designed such that the relation among distance (a), distance (c), length (d) and length (e) is length (d)>length (e)>distance (c)>distance (a).

In the present image forming apparatus, the length (e) of the transferring sheet P of the minimum size is equal to 148 mm (which is equal to the longitudinal length of the postcard size), and length (d)=188 mm, distance (c)=90 mm and distance (a)=30 mm.

What are important here are that the distance (a) between the fixing nip part and the fixing exit sensor 240 is short relative to the outer peripheral length d of the fixing roller (the distance from the rear end of the nip part downstream with respect to the conveying direction of the recording material), and that the distance (a) from the fixing nip part to the fixing exit sensor 240 should be made short to the utmost (the distance from the rear end of the nip part downstream with respect to the conveying direction of the recording material to the fixing exit sensor).

The magnitude relations between length (d) and length (e) and between distance (c) and distance (a) need not be restricted thereto. While in the present embodiment, the magnitude relations with respect to the distance (c) are shown, it is desirable that the distance (c) between the fixing entrance sensor 239 and the fixing exit sensor 240 be short relative to the outer peripheral length of the fixing roller, and that the distance (c) between the fixing entrance sensor 239 and the fixing exit sensor 240 be short relative to the transfer length (e) of the minimum size, but the relations between (c) and the others are not restricted thereto.

However, if the distance (c) between the fixing entrance sensor 239 and the fixing exit sensor 240 and the distance (a) between the fixing nip part and the fixing exit sensor 240 are long relative to the outer peripheral length (d) of the fixing roller, when the transferring sheet P has wrapped the fixing roller or the pressure roller, there is the possibility of a plurality of layers wrapping each roller, and the jam treatment of the transferring sheet P becomes difficult and therefore, it is preferable to construct the fixing apparatus in the relations that length (d)>distance (c) and that length (d)>distance (a).

Further, if the distance (a) from the fixing nip part to the fixing exit sensor 240 is made long as compared with the length (e) of the transferring sheet P, as described above, there is the possibility of all of the transferring sheet P wrapping the fixing roller 212 or the pressure roller 213 at a point of time whereat the delay of the transferring sheet P at the fixing exit sensor portion has been detected and therefore, the fixing apparatus must be constructed in the relation that distance (e)>distance (a). The shorter is the distance (a) between the fixing nip part and the fixing exit sensor 240, the earlier can be judged the detection of the delay of the transferring sheet P, and this is effective to prevent the transferring sheet P from wrapping the fixing roller 212 and the pressure roller 213. So, in the present image forming apparatus, the relation that distance (c)>distance (a) is adopted, but the relation between distance (c) and distance (a) need not be restricted thereto because it is enough if both distance (c) and distance (a) are sufficiently small relative to distance (e).

The fixing apparatus is constructed as described above, and the time from the passage of the transfer paper P by the fixing entrance sensor 239 till the arrival thereof at the fixing exit sensor 240 is monitored, and the fixing motor 260 is stopped when the arrival is delayed, whereby there is the effect of preventing the transferring sheet from wrapping each roller.

However, in the conventional type, the fixing motor 260 and the fixing roller 212 and the pressure roller 213 connected thereto are stopped by the use of only a rotation/stop command signal for controlling the operation/non-operation of the fixing motor 260, there has been the possibility that all the transferring sheet P cannot be prevented from wrapping each roller.

That is, in the stop control by the rotation/stop command signal for controlling the operation/non-operation of the fixing motor 260, the fixing roller 212 and the pressure roller 213 are naturally decelerated by the rotation resistance or the like thereof and therefore, the time until each roller is completely stopped is delayed in proportion to the inertia of these rollers and thus, the braking distance of the transferring sheet is extended. As a result, for example, in the case of transfer paper having a short length in the conveying direction like the postcard size, even if an attempt is made to stop the fixing roller 212 and the pressure roller 213 upon detection of the delay of the arrival of the paper at the fixing exit sensor 240 to thereby prevent the wrapping of the transfer paper, there is the fear that the transferring sheet will wrap the fixing roller 212 or the pressure roller 213.

As means for solving this, to the control of the fixing motor 260 in the present embodiment, besides the operation non-operation control, brake/non-brake control which is brake controlling means for controlling whether the rotor of the fixing motor 260 should be rendered free or fixed is added to thereby enhance the braking force for the fixing motor 260, and even in the case of the transferring sheet having a short length in the conveying direction like the postcard size, design is made such that it can be stopped at a position short of a position at which the trailing edge thereof is drawn into the nip part.

Motor coils in the present embodiment are constituted by three phases, and the terminal of each coil has connected thereto a source side transistor connected to a DC power source, and a sink side transistor connected to GND.

When the motor is to be rotated, the motor is rotated by turning on/off each source side transistor and each sink side transistor in a predetermined pattern to thereby successively excite the coils of respective phases.

Next, when the rotation of the motor is to be stopped, each source side transistor and each sink side transistor are turned off to thereby cut off an electric current supply route to the motor and stop the motor. At this time, the motor is gradually stopped by the inertial force by the rotation of the fixing roller, etc. Even after the motor is stopped, the control terminal of each coil is in an electrically open state and therefore, it is also possible to manually move the rotor. Here, this state is called a non-brake state.

When the motor is to be brought into its locked state, each source side transistor is turned off and the sink side transistor of each coil is turned on.

In this state, an oppositely directed electric current flows to the motor by an opposite electromotive voltage generated as a generator, and by this electric current, torque opposite to the original rotational direction is generated in the motor to thereby bring about a braking operation. Consequently, the motor being rotated is suddenly stopped, and after the stoppage, it becomes impossible to manually move the rotor. Herein, this state is called a locked state.

Figure 9A:
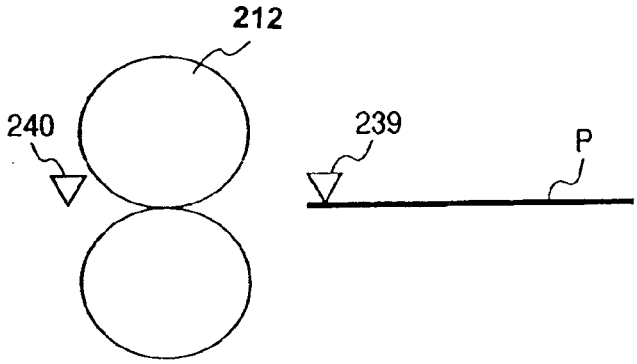
FIGS. 9A, 9B, 9C and 9D show the states when a recording material has wrapped around a fixing roller.
Figure 9B:
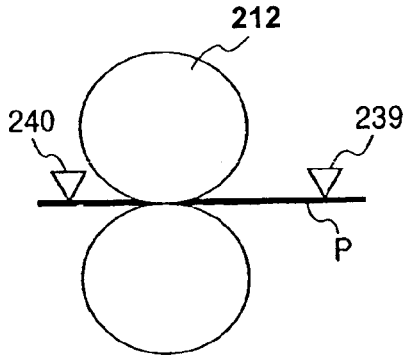

In the present embodiment, as described above, the electrical connection to the motor is set in three patterns. So, the substance of the present invention will now be described in detail with reference to FIGS. 9 and 10. FIG. 9A shows the timing at which the transferring sheet P has arrived at the fixing entrance sensor 239, and during a normal time when jam does not occur, the transferring sheet P arrives at the fixing exit sensor 240, as shown in FIG. 9B. FIG. 10A shows the detecting signals by the fixing entrance sensor 239 and the fixing exit sensor 240 at that time. That is, in a predetermined time after the detection of the transferring sheet P by the fixing entrance sensor 239, the transferring sheet P is detected by the fixing exit sensor 240.

Figure 9C:
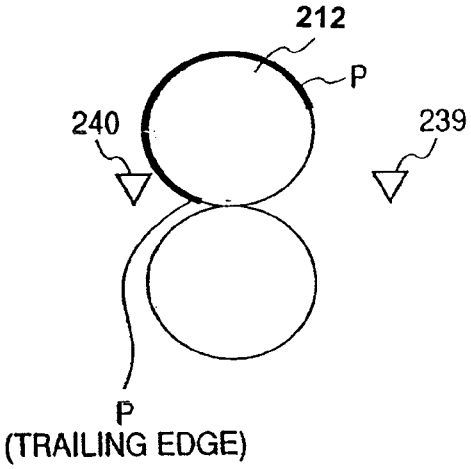
Figure 9D:
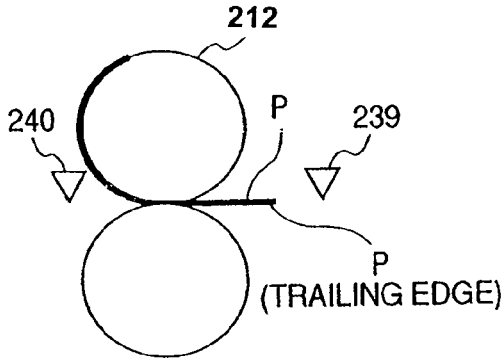
Figure 10A:
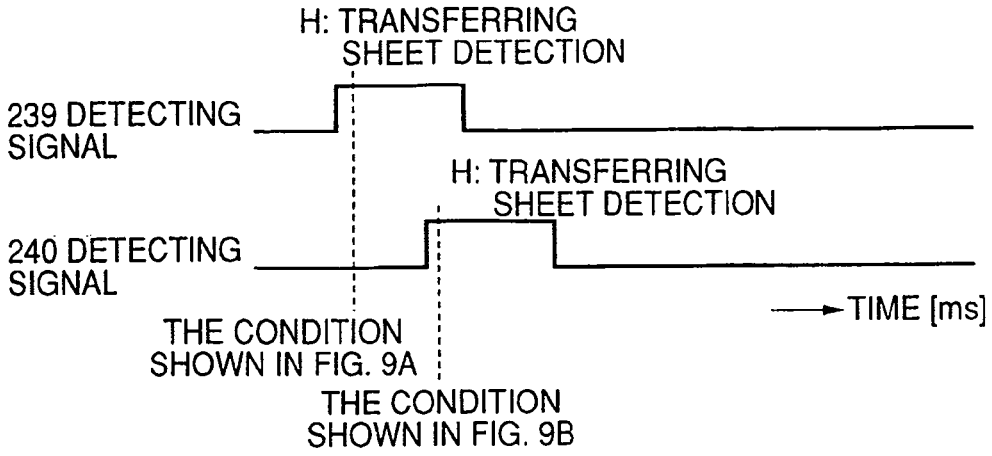
FIGS. 10A and 10B are timing charts showing the presence or absence of brake control.
Figure 10B:
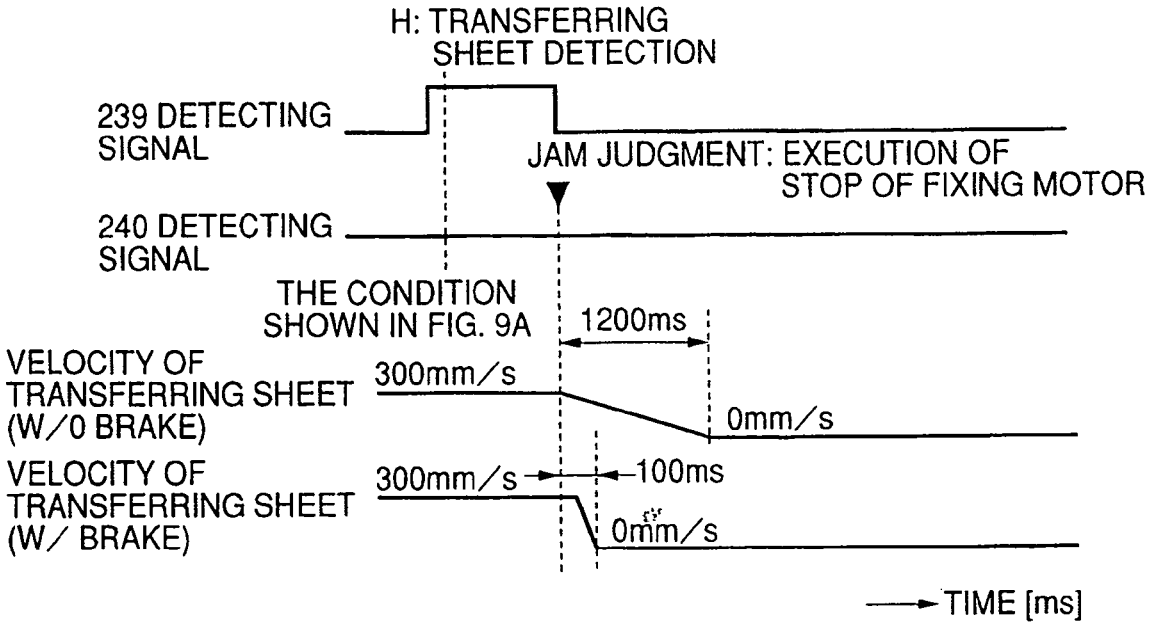

On the other hand, FIGS. 9C, 9D and 10B show the state when the transferring sheet P has wrapped around the fixing roller 212.

When as shown in FIG. 10B, the transferring sheet P is not detected by the fixing exit sensor 240 even if a predetermined time has elapsed after the transferring sheet P has been detected by the fixing entrance sensor 239, the fixing motor 260 is stopped.

Here, when as in the prior art, the fixing motor 260 is to be stopped by the use of only a rotation/stop command signal for controlling the operation/non-operation of the fixing motor 260, about 1200 ms is required till the stop in the present image forming apparatus. In the present image forming apparatus having a process speed of 300 mm/s, the transferring sheet P advances by about 180 mm during this time. As a result, when the transferring sheet P is of the postcard size (a length of 148 mm in the conveying direction), even the trailing edge of the sheet completely wraps the fixing roller 212, as shown in FIG. 9C.

In contrast, when a sudden brake is applied with the rotor of the fixing motor 260 fixed, the time required to stop the motor can be shortened to about 100 ms. The distance by which the transferring sheet P advances during this time is about 15 mm and therefore, even when the transferring sheet is of the postcard size (a length of 148 mm in the conveying direction), it becomes possible for the transferring sheet to be stopped with the trailing edge thereof left by about 100 mm. ("Sheet size: 148 mm"—"distance a between nip part rear end and fixing exit sensor: 30 mm"—"distance by which transferring sheet P advances till the stop of fixing motor 15 mm" ≈100 ms).

Thus, even in the case of a transferring sheet having a short length in the conveying direction like the postcard size, it can be stopped at a position before the trailing edge thereof is drawn into the nip part and therefore, the user becomes able to remove the transferring sheet by jam processing (jam treatment to remove twined sheet) without the sheet completely wrapping the fixing roller 212 and the pressure roller 213, and the safety of the image forming apparatus is improved.

In a braked state, it is impossible to manually rotate the fixing roller 212 and the pressure roller 213. Consequently, design is made such that during jam treatment, the system controller 101 can again control the fixing motor 260 to its non-braked state to thereby treat the jammed sheet residual at the fixing nip part.

In the present embodiment, the changeover to the non-brake during jam processing is carried out when the front door of the image forming apparatus has been opened. Here, the timing at which the fixing motor 260 is changed over to the non-brake is not restricted thereto, but the changeover may be carried out after the lapse of a predetermined time after the fixing motor has been stop-controlled. It is also possible to change over the fixing motor to the non-brake after by the use of a signal for monitoring the rotated state of the fixing motor like FG signal from the fixing motor which will be described later, it is detected that the motor has been completely stopped. In the sudden braking by the brake control of the fixing motor 260, in order to reduce the deterioration of service life due to a shock to the fixing motor 260 and the fixing roller 212 and the pressure roller 213 connected thereto, and a drive transmitting system such as gears, the brake control of the fixing motor 206 is carried out only during jam detected by the fixing entrance sensor and the fixing exit sensor.

Figure 6:
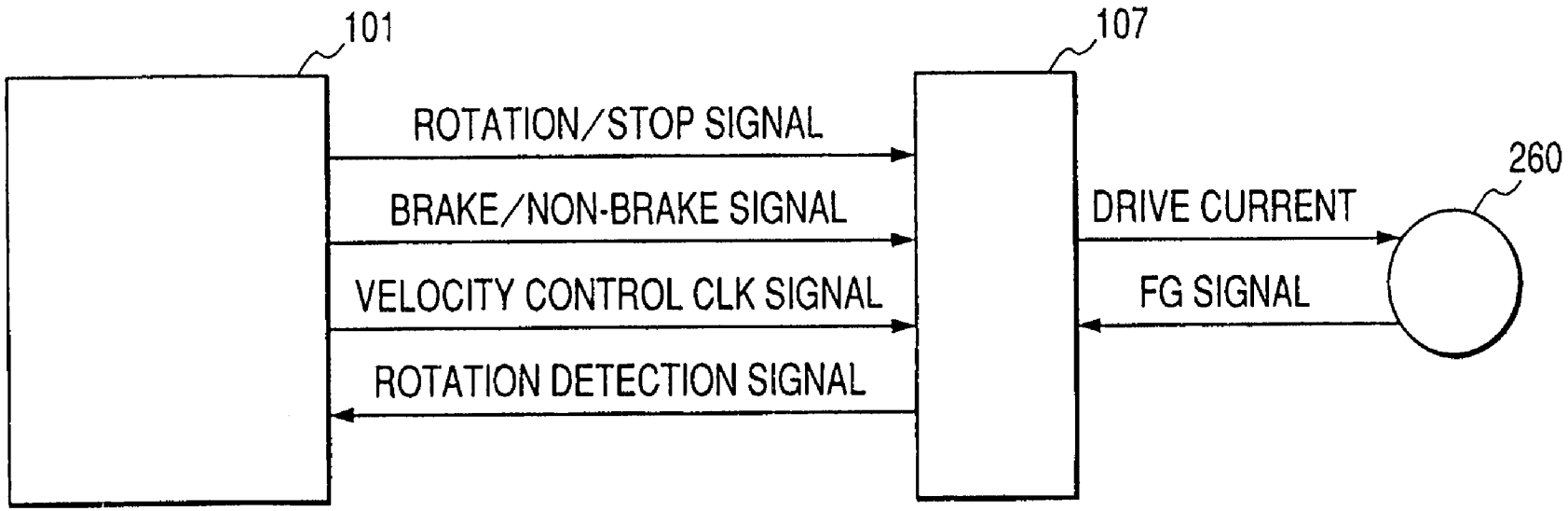
FIG. 6 shows a control signal for a fixing motor in the fixing apparatus according to the embodiment of the present invention.

The control of the fixing motor will now be described with reference to FIGS. 6 and 7. As shown in FIG. 6, a control signal from the system controller 101 to a motor controlling part 107 has a velocity control CLK signal for controlling the number of revolutions of the motor, in addition to the aforedescribed rotation/stop command signal and brake/non-brake signal. The fixing motor 260 is rotated at a number of revolutions conforming to the frequency of the velocity control CLK signal. A rotation detection signal for detecting whether the number of revolutions is within a number of revolutions within a predetermined range (±1% in the present embodiment) is detected by the motor controlling part 107, and is transmitted to the system controller 101. The motor controlling part 107 receives the FG signal detected by a detecting element for the rotated position, not shown, provided in the fixing motor 260 while controlling a drive current flowing to the fixing motor 260, in conformity with the system controller 101, and controls the fixing motor 260 on the basis of this FG signal so as to assume a predetermined number of revolutions.

Figure 7A:
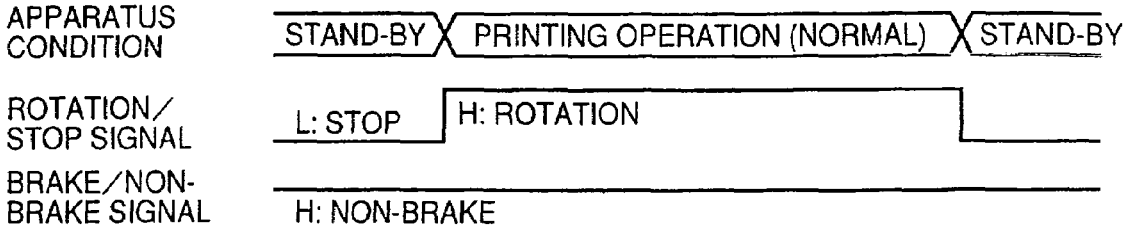
FIGS. 7A, 7B and 7C are timing charts of the action of the fixing apparatus according to the embodiment of the present invention.
Figure 7B:
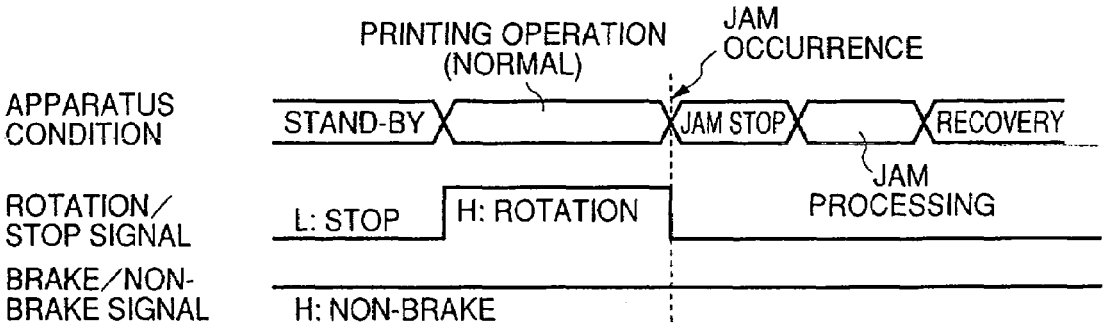
Figure 7C:
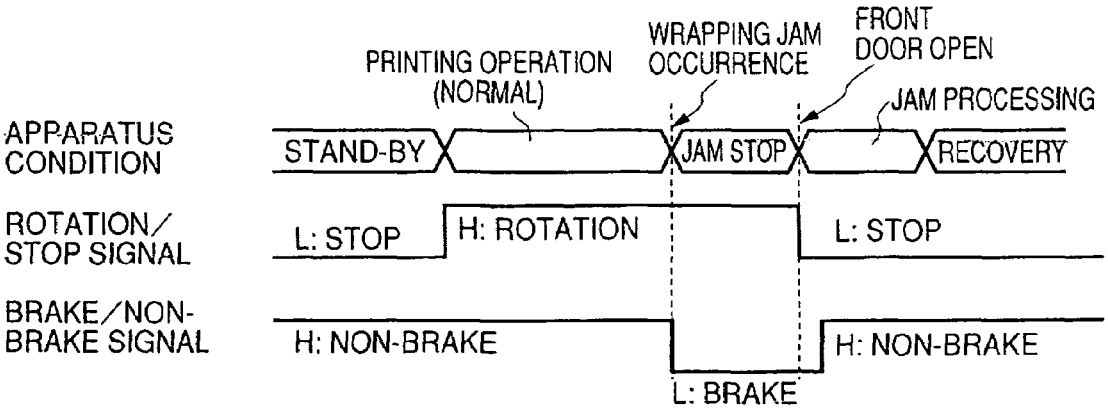

FIGS. 7A, 7B and 7C show the control sequences of the rotation/stop command signal and the brake/non-brake signal. FIG. 7A shows the sequence when the image forming apparatus is free of jam occurrence and performs the printing operation normally, 7B shows the sequence during the occurrence of other jam than wrapping jam (twining jam) in the fixing part, and FIG. 7C shows the sequence during the occurrence of the wrapping jam in the fixing part. FIG. 7A will first be described. When the image forming apparatus is in its stand-by state, the rotation/stop signal is set to the logic L of stop. Next, when the image forming apparatus enters the printing operation, the rotation/stop signal is set to the logic H of rotation, and the fixing motor 260 begins to rotate. When the printing state is normally completed, the rotation/stop signal is again set to the logic L of stop, and the job is completed. During this period, the brake/non-brake signal is always set to the logic H of non-brake.

Description will now be made of the sequence during the occurrence of other jam than the wrapping jam in the fixing part of FIG. 7B. When as in FIG. 7A, the image forming apparatus is in its stand-by state, the rotation/stop signal is set to the logic L of stop. When the image forming apparatus enters the printing operation, the rotation/stop signal is set to the logic H of rotation, and the fixing motor 260 begins to rotate. When during this printing operation, other jam (for example, the jam by mounting or delay in a sheet feeding part or a registration part) than the wrapping jam in the fixing part occurs, the rotation/stop signal is set to the logic L of stop, and the fixing motor 260 assumes a stop-controlled state. At this time, the fixing roller 212 and the pressure roller 213 which tend to be rotated by the inertial force thereof are stopped while being decelerated by rotation resistance or the like. Consequently, in this case, more or less time is required until the pair of fixing rollers are completely stopped, but there is no problem if the sheet is not present in the fixing part. Even during this period, the brake/non-brake signal is always set to the logic H of non-brake.

Description will now be made of the sequence during the occurrence of wrapping jam in the fixing part of FIG. 7C. When in the same manner as in FIGS. 7A and 7B, the image forming apparatus is in its stand-by state, the rotation/stop signal is set to the logic L of stop. When the image forming apparatus enters the printing operation, the rotation/stop signal is set to the logic H of rotation, and the fixing motor 260 begins to rotate. If during this printing operation, the wrapping jam in the fixing part occurs, the rotation/stop signal is set while remaining H and also, the brake/non-brake signal is set to the logic L of brake, and the fixing motor 260 becomes forcibly suddenly stopped.

Consequently, the fixing roller 212 and the pressure roller 213 which have tended to continue to be rotated by the inertial force thereof are also suddenly stopped, and the trailing edge of the jammed sheet wrapping the fixing roller 212 or the pressure roller 213 can be stopped at a position short of the fixing nip part.

Also, during processing of reducing jam issue, the system controller 101 first sets the rotation/stop signal to the logic L of stop after it has detected that the front door, not shown, of the image forming apparatus has been opened, and subsequently again sets the brake/non-brake signal to the logic H of non-brake to thereby render the drive shaft of the fixing motor 260 free and stopped. Then, the fixing roller 212 or the pressure roller 213 becomes manually rotatable, and the wrapping jammed paper can be removed.

While in the present embodiment, the motor controlling portion 107 is designed such that the fixing motor 260 is locked when the logic of the rotation/stop signal is brought into the state of H and the brake/non-brake signal is made into the logic L of brake, the logic of the rotation/stop signal when the fixing motor 260 is locked is not restricted thereto, but the motor controlling part 107 may be designed such that the fixing motor 260 is locked when, for example, the logic of the rotation/stop signal is brought into the state of L and brake/non-brake signal is made into the logic L of brake.

The system controller 101 sets the detection timing of this wrapping jam, i.e., the timing for carrying out brake control, in conformity with the number of revolutions of the fixing motor 260 to thereby suppress the wrong detection of the wrapping jam, and yet ensure the wrapping-jammed sheet to be reliably stopped short of the fixing nip part. This is necessary when, for example, the process speed for plain paper to pass through the fixing apparatus 3 and the process speed for thick paper to pass through the fixing apparatus 3 are to be changed, and when the passing velocity of the plain paper is defined as V1, and the detection timing of the wrapping jam thereof is defined as T1, and the passing velocity of the thick paper is defined as V2, and the detection timing of the wrapping jam thereof is defined as T2, these are in the relation that $T2=(V1\times T/V2)$.

(Details of the Control in the Image Forming Apparatus)

Figure 8:
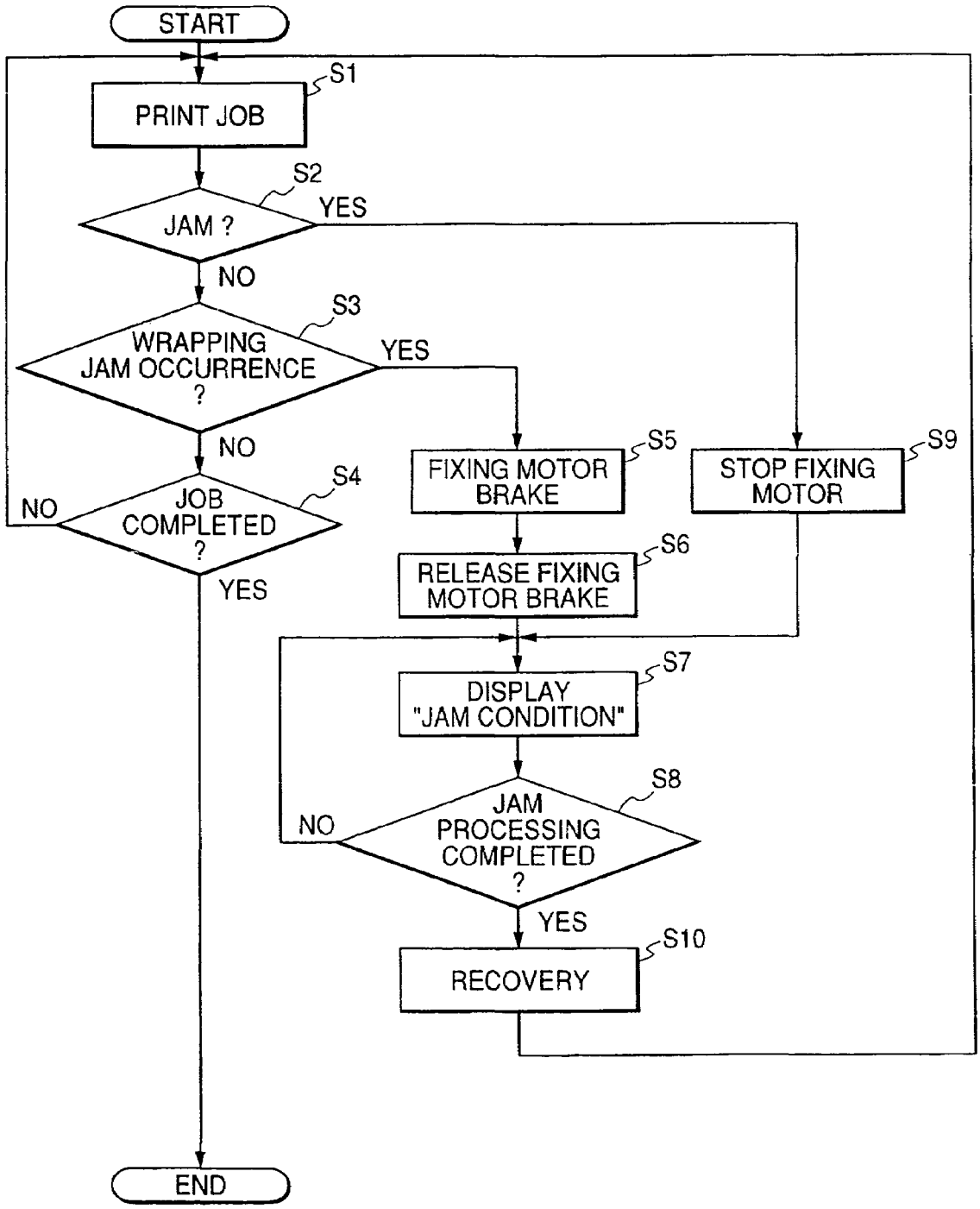
FIG. 8 is a flow chart of the action of the fixing apparatus according to the embodiment of the present invention.

The abnormality detecting sequence will hereinafter be described in greater detail with reference to FIG. 8. When a job is preengaged in the image forming apparatus, the system controller 101 operates various loads to thereby sequentially execute the sequence of a copy job while processing the signals of the various sensors (Step S1). During the sequence, the pressure or absence of the occurrence of jam in the image forming apparatus is always monitored on the basis of the sheet detecting sensor of each conveying system (step S2 and step S3). If there is no jam and the sequence is normally progressed, the predetermined sequence is repeated until the print job is completed (step S4), and when all jobs are completed, the image forming apparatus returns to its stand-by state.

On the other hand, when during the sequence, other jam in the conveying path than the wrapping jam in the fixing part occurs (step S2), as a means for releasing the operations of the various loads, the rotation/stop signal of the fixing motor 260 is set to the logic L of stop to thereby stop the fixing motor (step S9). At this time, the fixing roller 212 and the pressure roller 213 which tend to continue to be rotated by the inertial forces thereof are stopped while being decelerated by rotation resistance or the like.

Also, when during the sequence, the wrapping jam in the fixing part occurs (step S3), the operations of the various loads are likewise released, and also the brake/non-brake signal is set to the logic L of brake while the rotation/stop signal of the fixing motor 260 is made into H. Thereby, the fixing motor 260 is forcibly suddenly stopped, and the fixing roller 212 and the pressure roller 213 which have tended to continue to be rotated by the inertial forces thereof are also suddenly stopped, and the trailing edge of the jammed sheet wrapping the fixing roller 212 or the pressure roller 213 is stopped short of the fixing nip part (step S5). Subsequently, the opening of the front door, not shown, of the image forming apparatus is detected, whereafter the rotation/stop signal is first set to the logic L of stop, and subsequently the brake/non-brake signal is again set to the logic H of non-brake, and the drive shaft of the fixing motor 260 is rendered into a freely stopped state and the fixing roller 212 or the pressure roller 213 is rendered manually rotatable to thereby enable the wrapping jammed sheet to be treated (step S6).

When jam condition is detected at the step S2 or the step S3, the image forming apparatus is stopped as described above, whereafter the jam condition display for notifying jam processing is effected until the jammed sheet is completely removed (step S7 and step S8). When the jam treatment is done, subsequently the recovery operation of returning the various loads to a start position or returning the fixing heater to the stand-by temperature is performed (Step S10), and the so far interrupted print job is resumed.

Figure 11:
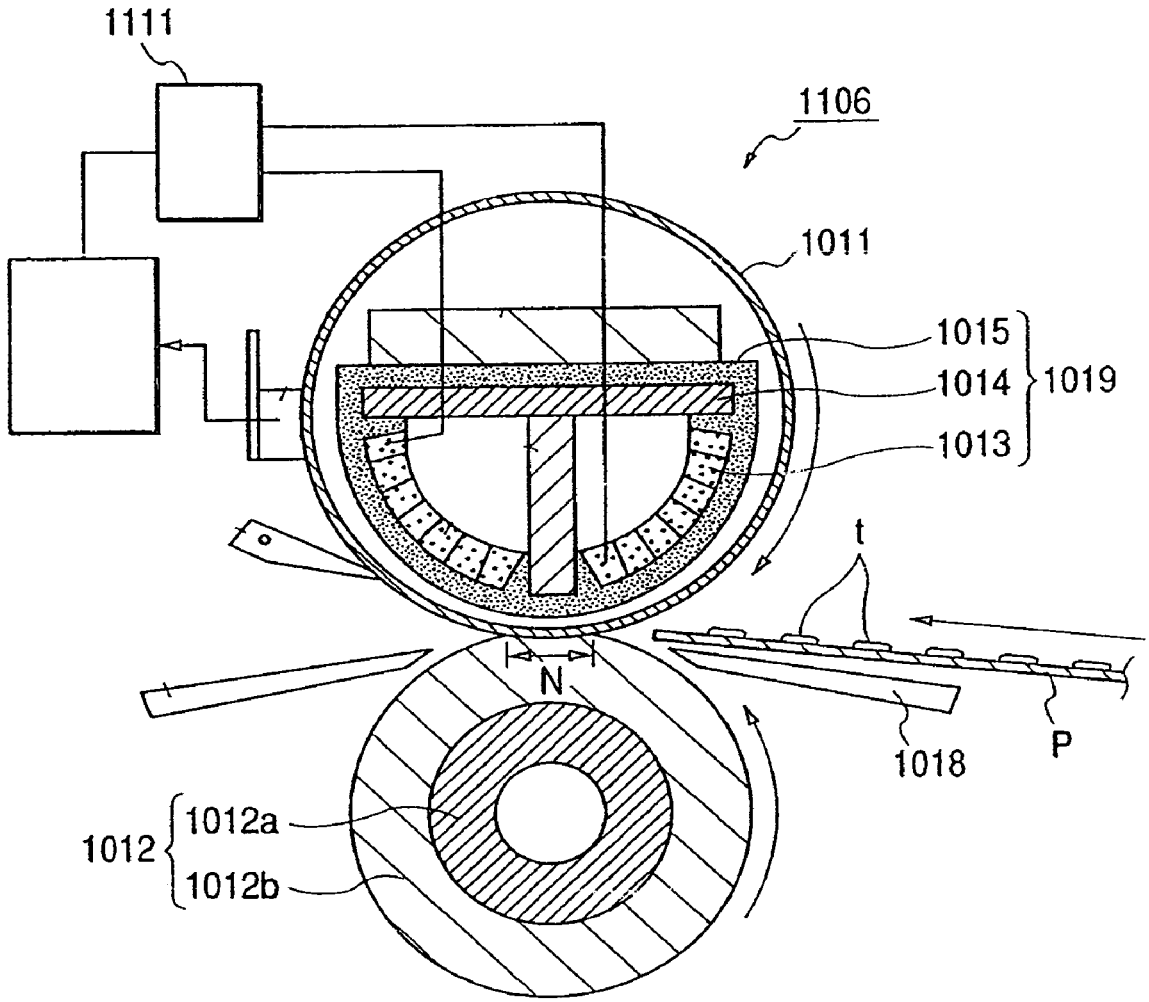
FIG. 11 shows an image heating apparatus using an inductive heating process.

While in the present embodiment, the fixing roller is designed to be heated by the halogen heater, the present invention is not restricted to such construction. As another example, the present invention can be used, without any problem, in a construction of an inductance heating type in which by the use of a coil for generating a magnetic field, a heating member itself generates heat by an eddy current produced in the electrically conducting layer of the heating member by the magnetic field. FIG. 11 is a transverse cross-sectional model view of a heating and fixing apparatus 1106 using the heating apparatus of the present invention as a heat source. This heating and fixing apparatus 1106 is an apparatus of a heat roller type in which recording paper P as a recording material bearing an unfixed toner image t thereon is introduced into a fixing nip part N which is a pressure contact portion between a fixing roller 1011 as an inductance-heated heating member and a pressure roller 1012 as a pressure member and is nipped and conveyed, and in the fixing nip part N, the unfixed toner image t is heat-pressure-fixed on the surface of the recording paper P by the heat and nip pressure of the fixing roller 1011.

The fixing roller 1011 is an iron mandrel cylinder which is a magnetic metal member having an outer diameter of 40 mm and a thickness of 0.7 mm, and in order to enhance mold releasability, a layer of fluorine resin such as PTFE or PFA having a thickness of 10 to 50 μm may be provided on the outer peripheral surface thereof.

The fixing roller 1011 has its opposite end portions rotatably mounted and supported on a fixing unit frame through bearings, and is rotatively driven at a predetermined peripheral speed in the clockwise direction of arrow by a driving system, not shown.

The pressure roller 1012 comprises a hollow mandrel 1012*a* and an elastic layer 1012*b* which is a surface mold releasable heat-resistant rubber layer formed on the outer peripheral surface thereof. This pressure roller 1012 is disposed under and in parallelism to the fixing roller 1011, and has the opposite end portions of its hollow mandrel 1012*a* rotatably supported on the fixing unit frame, not shown, through bearings, and is upwardly biased toward the rotary shaft of the fixing roller 1011 by a biasing mechanism, not shown, using a spring or the like, and is urged against the underside of the fixing roller 1011 with a predetermined pressure force.

By the pressure contact of the pressure roller 1012 with the fixing roller 1011, the elastic layer 1012*b* is elastically deformed at the portion of pressure contact thereof with the fixing roller 1011, and a fixing-nip part N of a predetermined width as a heating part for a material to be heated is formed between the pressure roller and the fixing roller 1011. In the present example, the pressure roller 1012 is loaded with total pressure of about 304N (about 30 kg) and the nip width of the fixing nip part N in that case is about 6 mm. The pressure roller 1012 is driven to rotate by a pressure contact frictional force at the fixing nip part N with the rotative driving of the fixing roller 1011. However, these values of the total pressure and the nip width are merely examples, and any other values will pose no problem.

The reference numeral 1019 designates an inductance coil assembly as magnetic flux generating means, and it comprises an inductance coil 1013, a magnetic core 1014, a coil holder 1015, etc. The inductance coil 1013 is covered with a cover member formed of a heat-resistant material such as polyimide or polyamideimide. The coil holder 1015 is a member having a semicircular trough-shaped transverse cross section and formed of heat-resistant resin such as PPS, PEEK or phenol resin, and the induction coil 1013 wound in a boat shape and the magnetic core 1014 comprising flat ferrite plates having a thickness of 4 mm combined into a T-shape are contained inside the coil holder 1015 to thereby provide the induction coil assembly 1019. The outer surface of this coil holder 1015 is disposed so as to be opposed to the inner surface of the fixing roller 1011. Also, the induction coil 1013 is in close contact with the coil holder 1015.

The induction coil assembly 1019 is held by a stay 1006 and is inserted into the hollow portion of the fixing roller 1011, and with the semicircular surface side of the coil holder 1015 brought into a downwardly facing posture, the opposite end portions of the stay 1006 are fixed to an supported by the fixing unit frame, not shown. The induction coil assembly 1019 is disposed so that a gap may be provided between this induction coil assembly 1019 and the fixing roller 1011.

The fixing roller 1011 is rotatively driven and the pressure roller 1012 is driven to rotate thereby, and an alternating current of 10 to 100 kHz is applied from an excitation circuit 1111 to the induction coil 1013. A magnetic field induced by the alternating current makes an eddy current flow to the inner surface of the fixing roller 1011 which is an electrically conducting layer to thereby generate joule heat. That is, the fixing roller 1011 is inductance-heated. The present invention can also be used in such an inductance heating apparatus to obtain a similar effect.

In the present embodiment, there has been shown a construction using the fixing roller as a first rotary member, and the pressure roller as a second rotary member. Besides this embodiment, even a construction adopting a combination of a photosensitive member which is an image bearing member as the first rotary member and a transferring rotary member as the second rotary member which rotates in contact with the photosensitive member will pose no problem. By adopting the present invention in such a construction, it is possible to prevent a recording material from being electrostatically attracted to the photosensitive member, and wrapping the photosensitive member.

Also, in the present embodiment, as brake control means, the braking force of the brake means has been set to two stages of ON and OFF, but there will be no problem even if there is adopted such a construction in which the kinds of the braking force are increased so that during jam near the fixing roller, the greatest braking force may be selected, and during other jam, the next greatest braking force may be selected, and in the case of non-jam, the brake may be rendered OFF.

Also, while in the present embodiment, the brake means is provided on the motor which is the drive means, no problem will arise even in the case of such brake means as forcibly stops the rotation of a shaft such as a drive shaft.

As described above, the present invention has the construction and action as described above and therefore, can reduce the rotation of the rotary member by the inertia thereof, and can reduce the amount by which the recording material wraps the rotary member.

Further, as described above, the drive means is brake-controlled only during jam, whereby it is possible to suppress the deterioration of the service life of the drive transmitting system including the drive means and the rotary member driven by the drive means which is attributable to the shock during braking.

While the embodiment of the present invention has been described above, the present invention is in no way restricted to the above-described embodiment, but all modifications are possible within the scope of the technical idea of the present invention.

What is claimed is:

1. An image forming apparatus, comprising:

image forming means which forms a toner image on a recording material;

a fixing rotation member which fixes the toner image formed on the recording material at a nip portion;

a pressure rotation member which forms the nip portion by contacting the pressure rotation member with said fixing rotation member with pressure;

a driving motor which drives said fixing rotation member and said pressure rotation member;

detection means which detects an abnormal state of conveyance of a recording material caused at the nip portion;

lock means which effects locking of said driving motor when the abnormal state is detected by said detection means;

release means which effects releasing of the locking of said driving motor; and an open-close door provided so as to be accessed to a recording material in the abnormal state of conveyance, wherein the releasing of said driving motor by said release means is effected with opening movement of said open-close door.

2. An image forming apparatus comprising:

image forming means which forms a toner image on a recording material;

a fixing rotation member which fixes the toner image formed on the recording material at a nip portion;

a pressure rotation member which forms the nip portion by contacting the pressure rotation member with said fixing rotation member with pressure;

a driving motor which drives said fixing rotation member and said pressure rotation member;

detection means which detects an abnormal state of conveyance of a recording material caused at the nip portion;

lock means which effects locking of said driving motor when the abnormal state is detected by said detection means; and release means which effects releasing of the locking of said driving motor, wherein said release means effects releasing of said driving motor after a predetermined time period from a time when said lock means effects locking of said driving motor.

* * * * *

UNITED STATES PATENT AND TRADEMARK OFFICE

CERTIFICATE OF CORRECTION

PATENT NO. : 7,110,689 B2
APPLICATION NO. : 10/834237
DATED : September 19, 2006
INVENTOR(S) : Katsumi Takahashi It is certified that error appears in the above-identified patent and that said Letters Patent is hereby corrected as shown below:

ON THE TITLE PAGE, AT ITEM (57), Abstract:
Line 6, “tot he” should read --to the--.

COLUMN 1:
Line 12, “etc.” should read --etc.,--.
Line 20, “facsimile-” should read --facsimile--.

COLUMN 2:
Line 53, “calls” should read --calls for--.

COLUMN 3:
Line 36, “flow chart” should read --flowchart--.

COLUMN 4:
Line 39, “7Y, 7C” should read --7Y, 7M, 7C--.
Line 60, “but” should read --out--.

COLUMN 6:
Line 42, “data.” should read --data. ¶ (Construction of the Fixing Apparatus) ¶--.

COLUMN 7:
Line 1, “1[mm]” should read --1mm--.
Line 34, “of” should read --of a--.
Line 39, “arrive” should read --arrive at--.
Line 59, “are” (second occurrence) should read --are:--.

COLUMN 8:
Line 12, “transfer” should read --transfer paper--.

COLUMN 9:
Line 8, “operation” should read --operation/--.

COLUMN 10:
Line 55, “motor 206” should read --motor 260--.

COLUMN 13:
Line 51, “of” should read --of the--.

UNITED STATES PATENT AND TRADEMARK OFFICE

CERTIFICATE OF CORRECTION

PATENT NO. : 7,110,689 B2
APPLICATION NO. : 10/834237
DATED : September 19, 2006
INVENTOR(S) : Katsumi Takahashi It is certified that error appears in the above-identified patent and that said Letters Patent is hereby corrected as shown below:

COLUMN 14:
Line 1, "fixing-nip" should read --fixing nip--.

Signed and Sealed this

Twelfth Day of June, 2007

JON W. DUDAS
*Director of the United States Patent and Trademark Office*